US005936175A

United States Patent [19]

Simons

[11] Patent Number: 5,936,175

[45] Date of Patent: Aug. 10, 1999

[54] DRUM HEAD ASSEMBLY

[75] Inventor: Richard D. Simons, Garfield, N.J.

[73] Assignee: Latin Percussion, Inc., Garfield, N.J.

[21] Appl. No.: 08/908,219

[22] Filed: Aug. 7, 1997

[51] Int. Cl.[6] ..... G10D 13/02

[52] U.S. Cl. ..... 84/413

[58] Field of Search ..... 84/411 A, 413, 84/415, 411 R

[56] References Cited

U.S. PATENT DOCUMENTS

| | | | |
|---|---|---|---|
| 614,694 | 11/1898 | Boulanger . | |
| 3,955,465 | 5/1976 | Zickos . | |
| 4,060,018 | 11/1977 | Gilbrech . | |
| 4,122,748 | 10/1978 | May | 84/411 A |
| 4,154,137 | 5/1979 | Kobayashi . | |
| 4,549,462 | 10/1985 | Hartry et al. | 84/413 |
| 4,754,683 | 7/1988 | Townsend et al. . | |
| 4,967,634 | 11/1990 | Whynott . | |
| 5,375,500 | 12/1994 | Halpin . | |
| 5,404,785 | 4/1995 | Belli . | |
| 5,417,136 | 5/1995 | Kralik et al. | 84/411 R |
| 5,517,890 | 5/1996 | Cooperman . | |
| 5,554,812 | 9/1996 | Donohoe | 84/413 |

FOREIGN PATENT DOCUMENTS

| | | |
|---|---|---|
| 0 275 187 A2 | 7/1988 | European Pat. Off. . |
| 65886 | 12/1992 | Germany . |
| 2 150 732 | 7/1985 | United Kingdom . |

*Primary Examiner*—Jeffrey W. Donels
*Attorney, Agent, or Firm*—Ohlandt, Greeley, Ruggiero & Perle

[57] ABSTRACT

An integral drum head assembly including a drum head frame, a skin adapted to be positioned about the frame, a mount for mounting the skin firmly to the frame, and a tensioning device for tensioning the skin. The skin tensioning device has a surface for pressing against the skin, and has an adjuster for moving the tensioning device surface relative to the frame.

20 Claims, 6 Drawing Sheets

DRUM HEAD ASSEMBLY

The present invention relates generally to a drum head assembly. More particularly, the present invention relates to a drum head or frame drum that includes integral and skin clamping and skin tensioning devices. This provides an integral drum head assembly that does not have a need for an external rim, lugs, side plates or any other hardware that transfers head tension to the shell, and that can be adapted for use with many types and sizes of drums.

BACKGROUND OF THE INVENTION

Various types of drum heads and drum head mounting assemblies are known in the art of musical instruments. Typically, a drum head, or skin (so-called whether made of animal skin or synthetic materials), is drawn over the open top (and/or bottom) of a drum body and is attached to the exterior of the drum body by tacks or hooks. While generally satisfactory, this type of drum has been found to have certain drawbacks. For example, these types of drum heads are permanently affixed, in numerous locations, to the drum body, making disassembly difficult or impossible. In addition, they typically have bulky rims and external attachment hardware that is aesthetically undesirable, and that can impede unrestrained play, particularly play by hand, by presenting hard, irregular, and protruding surfaces that the player is likely to hit.

Traditional drum head assemblies are also difficult to tune and adjust. Typical tensioning hardware, like the mounting hardware, is located externally, where it limits the player's ability to play. This hardware can be a safety hazard, and is not aesthetically desirable. Internal tensioning devices are known, but are difficult to access and manipulate in drums having permanently affixed drum heads.

Accordingly, a drum head having tensioning and mounting means that are accessible to the user, while not hindering the use or detracting from the appearance of the drum, is needed.

SUMMARY OF THE INVENTION

Accordingly, it is an object of the present invention to provide an integral drum head assembly having a skin, frame and tensioning means in a single discrete unit.

It is another object of the present invention to provide such a drum head that does not employ a traditional drum rim, thus providing an unimpeded playing surface with improved utility and appearance.

It is a further object of the present invention to provide such a drum head assembly that removably secures the skin via a clamping action, obviating the need for adhesives or a traditional mounting ring known as a skinwire.

It is still a further object of the present invention to provide such a drum head assembly that can be adjusted and re-tensioned by rotation or racheting of the frame in relation to the bearing ring.

It is still a further object of the present invention to allow the testing of various materials for the vibrating membrane/skin without the need of any shell.

Accordingly, the present invention discloses an integral drum head assembly including a drum head frame, a skin adapted to be positioned about the frame, a mount for mounting the skin firmly to the frame, and a tensioning device for tensioning the skin. The skin tensioning device has a surface for pressing against the skin, and has an adjuster for moving the tensioning device surface relative to the frame.

DESCRIPTION OF THE PREFERRED EMBODIMENTS

Figure 1:
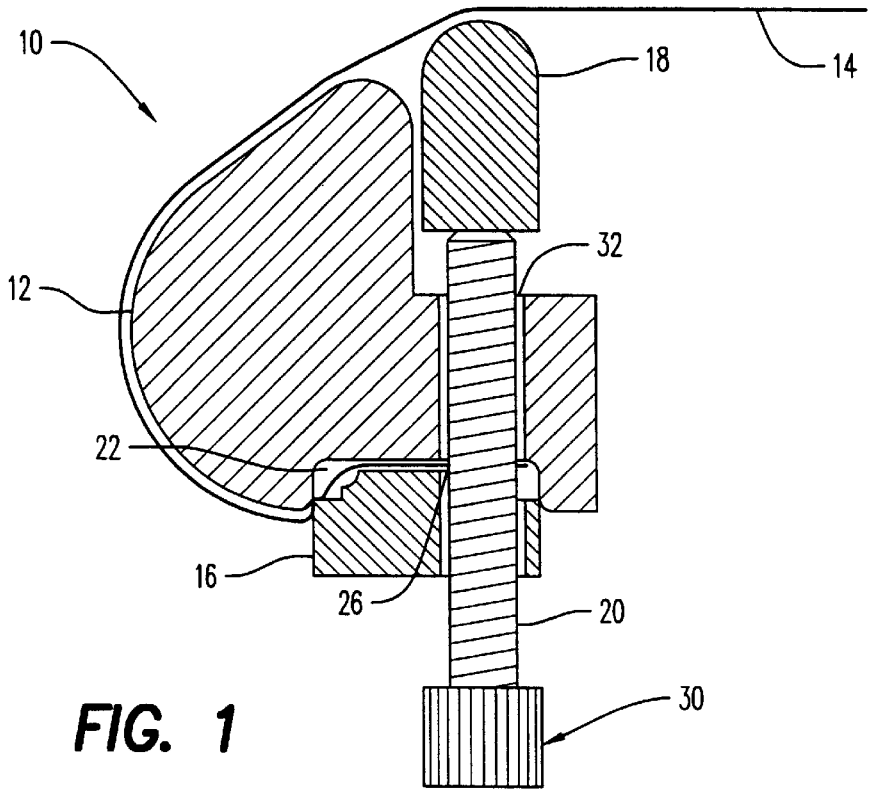
FIG. 1 is a partial cross-sectional view of a first embodiment of a drum head assembly according to the present invention.

Referring to the drawings and, in particular, FIG. 1 that depicts a preferred embodiment drum head assembly according to the present invention, there is shown a drum head assembly generally referred to by reference numeral 10. The drum head assembly 10 includes a frame 12, a skin 14, a skin mounting ring 16, a bearing ring 18 and one or more (preferably at least three) screws 20. Collectively, these elements make up a frame drum, which can be used independent of a separate drum body.

Figure 7:
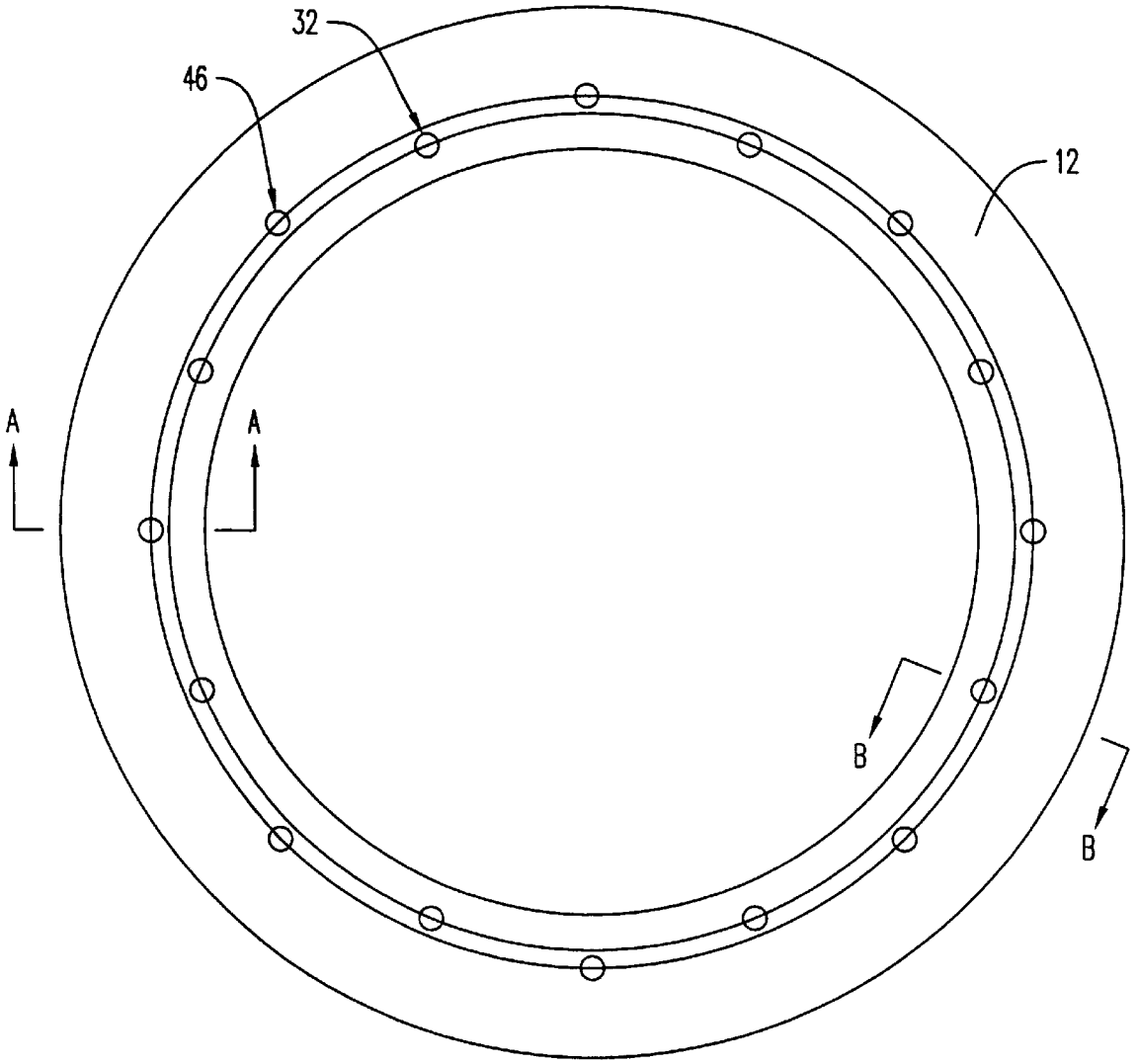
FIG. 7 is a bottom view of the frame of the drum head assembly of FIG. 1.

Preferably, frame 12 is sized with an internal diameter slightly less than (for vertical attachment) or slightly greater than (for telescoping attachment) the top external diameter of a drum body (not shown). Drum head assembly 10 can thus be removably mounted over the open top of a drum body to form a complete drum assembly. Separate mounting means such as screws through the shell into the underside of drum head assembly 10, or, depending on the shell, through a flange on the inside of the shell, can be used to mount drum head assembly 10 to a drum body. One preferred vertical mounting means is shown in FIG. 7 and will be discussed later.

Frame 12 has a lower surface that forms a channel 22. Channel 22 is designed to accept skin mounting ring 16. The skin mounting ring 16 can be secured with screws, rivets, pins, etc. This permits skin 14 to be stretched over frame 12 and to be securely clamped between the frame and skin mounting ring. Other variations allow a tapered skin mounting ring 16 to lock the skin 14 with no hardware. In addition, skin mounting ring 16 can be located internally or externally (see FIG. 9, discussed below). Preferably, skin 14 and skin mounting ring 16 have holes 26,32 to allow screws 20 to thread through frame 12 to provide a tensioning force on bearing ring 18.

Screws 20 serve primarily to position bearing ring 18 against skin 14, to tension and tune the pitch of drum head assembly 10. Bearing ring 18 is preferably seated circumferentially within frame 12. Screws 20 abut against bearing ring 18 at a first end, and preferably have a grippable head 30 at a second end. Screws 20 can be any conventional screws, but are preferably Allen head screws. Frame 12 includes threaded slots 32 to accept and engage screws 20, such that when torque is applied by the user to heads 30, screws 20 rotate in slots 32, forcing bearing ring 18 upward. Thus, bearing ring 18 presses against and applies tension to skin 14 to allow a sagging skin to be tightened and the tone of a skin to be varied. Rotation of screws 20 in an opposite direction releases tension on skin 14, effecting a lower tone and a looser skin. Slots 32 preferably pass through skin mounting ring 16 as well, through holes 26 that do not impede the turning of screws 20.

Bearing ring 18 preferably has a tapered upper surface, to provide a lower friction contact between bearing ring 18 and skin 14. A rounded contour is preferred, but any traditional or modern contour can be used, including flat surfaces and V-shaped contours. Bearing ring 18 is preferably annular (as indicated by the term "ring"), but other geometric shapes can also be used. This is also true of frame 12 and skin mounting ring 16. Moreover, bearing ring 18 and skin mounting ring 16 can also be made up of a plurality of non-continuous, discrete elements that function in tandem to vary the tension on the skin (bearing ring 18) or hold the skin in channel 22 (mounting ring 16). Bearing ring 18 and screws 20 preferably do not extend inwardly past the innermost surface of frame 12. This facilitates the mounting of drum head assembly 10 on a drum body, and provides clearance to allow the user to access and rotate heads 30.

Figure 2:
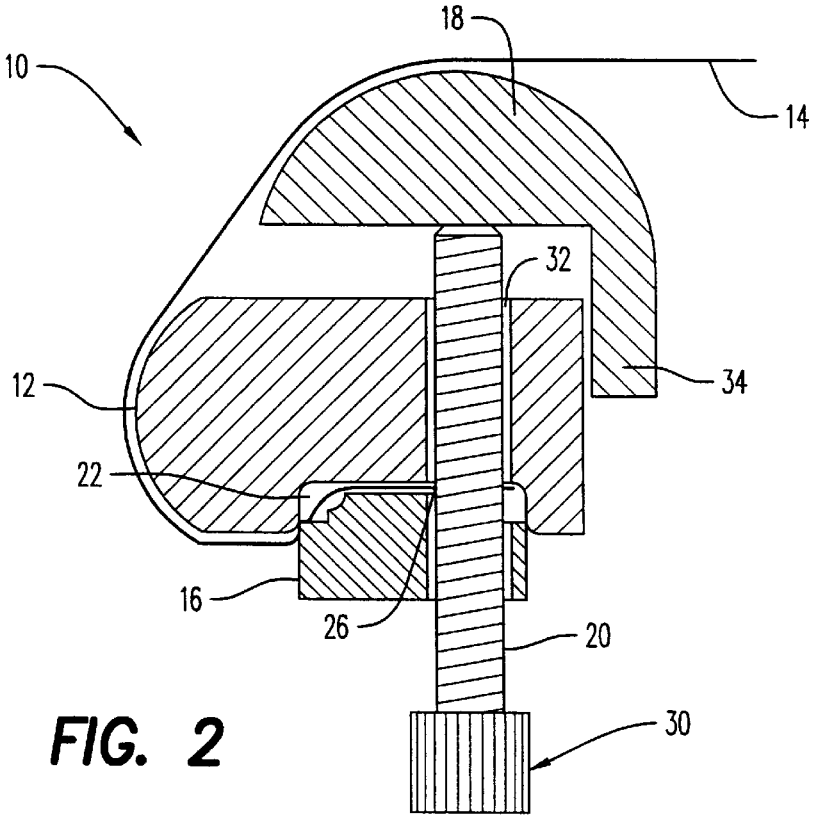
FIG. 2 is a partial cross-sectional view of a second embodiment of a drum head assembly according to the present invention.

FIG. 2 depicts an alternate preferred embodiment of the drum head assembly 10 of the present invention, wherein like elements are designated with like numbers. This embodiment differs from that of FIG. 1 primarily in the shape of the bearing ring 18 and frame 12. Bearing ring 18 has a greater width than that of FIG. 1, although its contour is still preferably rounded. Bearing ring 18 also includes a depending lip 34 that abuts the internal face of frame 12, and slides along it when moved up or down by screws 20.

Figure 3:
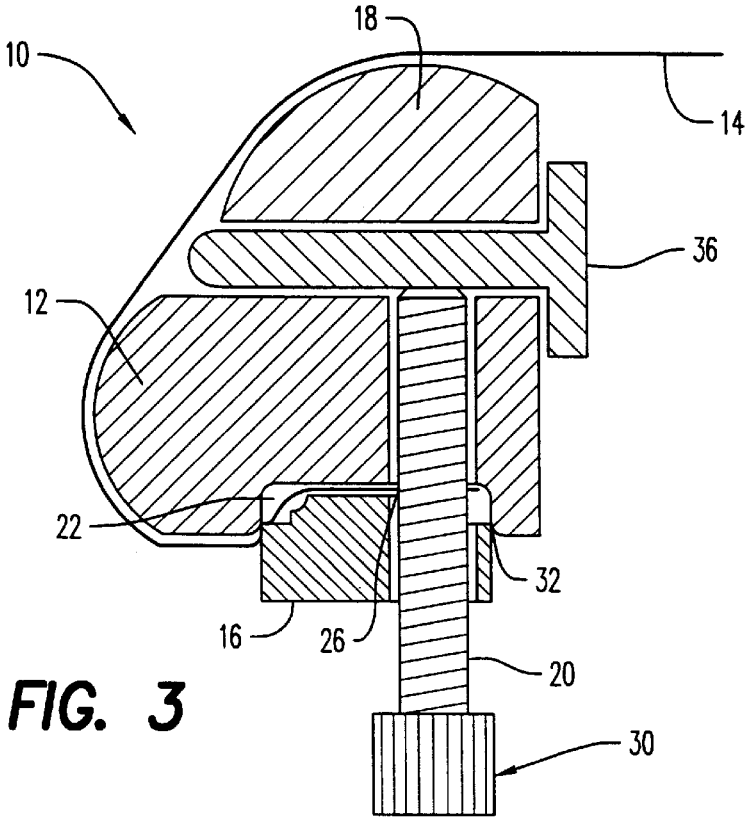
FIG. 3 is a partial cross-sectional view of a third embodiment of a drum head assembly according to the present invention.

FIG. 3 shows a further preferred embodiment of the drum head assembly 10 of the present invention. It has a frame 12 of substantially the same configuration as that of FIG. 2. In the embodiment of FIG. 3, however, the bearing ring 18 does not have a depending lip 34, but instead ends in a flat surface substantially parallel to the internal face of frame 12. Interposed between frame 12 and bearing ring 18 is a flange 36 that is preferably made of steel, and that preferably has a T-shaped cross-section. Screws 20 pass through skin mounting ring 16 and frame 12. Thus, screws 20 act directly on flange 36, and the force applied to flange 36 is transferred to bearing ring 18 and to skin 14. The flange 36 provides a durable surface that is less likely to become marred by screws 20 over time.

Figure 4:
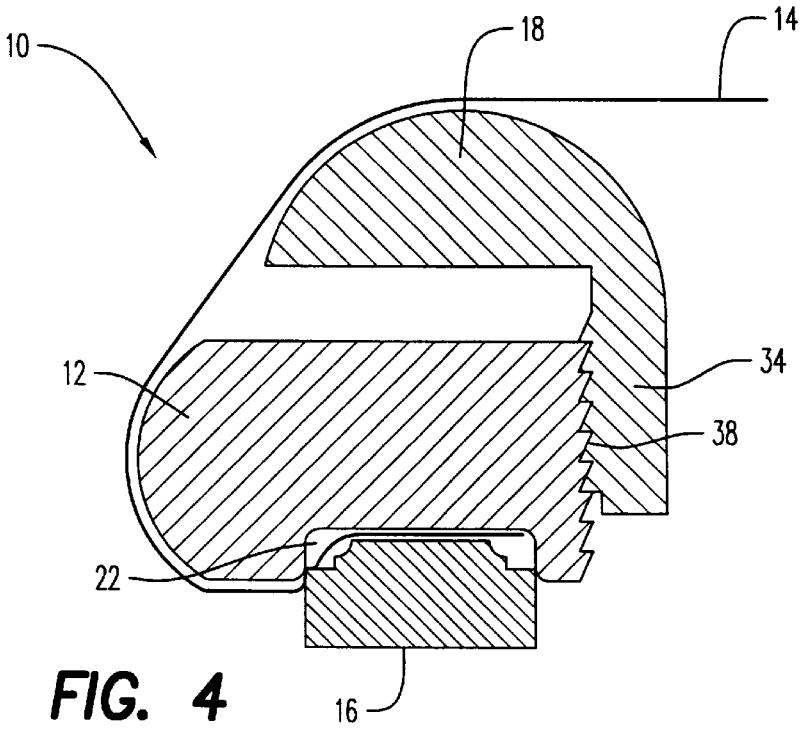
FIG. 4 is a partial cross-sectional view of a fourth embodiment of a drum head assembly according to the present invention.

FIG. 4 depicts a further preferred embodiment of the drum head assembly 10 of the present invention. In this embodiment, bearing ring 18 has a configuration similar to that of the embodiment of FIG. 2. However, depending lip 34 of bearing ring 18 has a notched surface 38, to mate with a notched inner surface of frame 12. Bearing ring 18 is adjusted up and down relative to frame 12 by a ratcheting movement. The notched depending lip 34 of bearing ring 18 is held in the notches on frame 12 by a compression fit. Upward pressure on bearing ring 18, preferably pressure on the bottom surface 40 of depending lip 34, causes bearing ring 18 to ratchet upward one or more notches. This pressure is preferably applied by mechanical means during manufacturing. When the notches in bearing ring 18 and frame 12 have the upward bias shown in FIG. 4, downward adjustment of bearing ring 18 is not possible unless the skin 14 is removed. Accordingly, this embodiment preferably accommodates only tightening of the skin at assembly, and not full range tuning capabilities. Such a configuration would be more suited to a toy drum or similar product. Although not shown in this embodiment, screws 20 can be incorporated into drum head assembly 10 to act as an upward force on bearing ring 18 as well.

Figure 5:
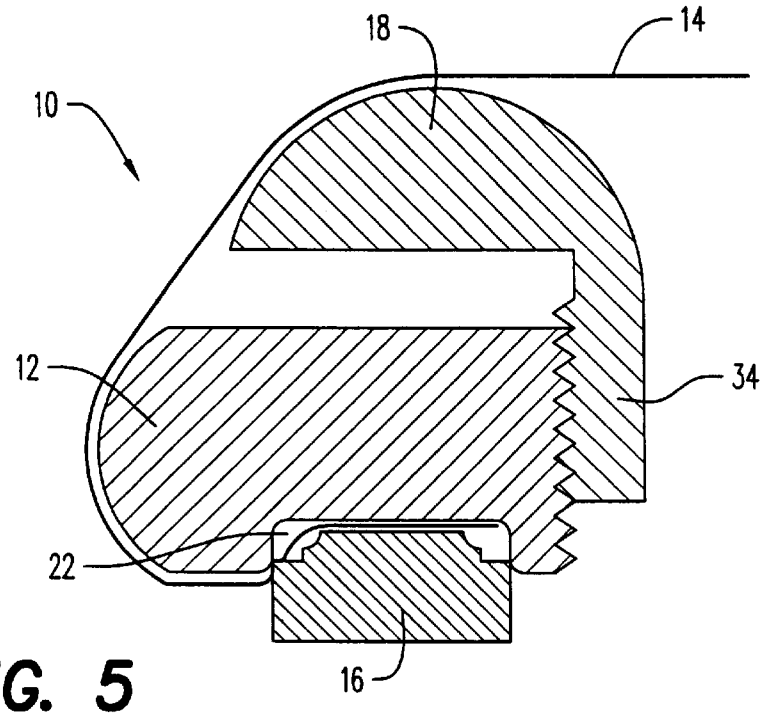
FIG. 5 is a partial cross-sectional view of a fifth embodiment of a drum head assembly according to the present invention.

The embodiment of FIG. 5 is almost identical to that of FIG. 4, with the exception that depending lip 34 of bearing ring 18 and frame 12 have mating threaded surfaces, instead of mating notched surfaces. This permits bearing ring 18 to be adjusted up and down relative to frame 12 by rotating the bearing ring. Like that of FIG. 4, this unique construction provides a drum that is easy to tension and adjust, and that is composed of very few pieces. Accordingly, the embodiments of FIGS. 4 and 5 are well suited to being fabricated entirely from molded plastic parts.

Figure 6:
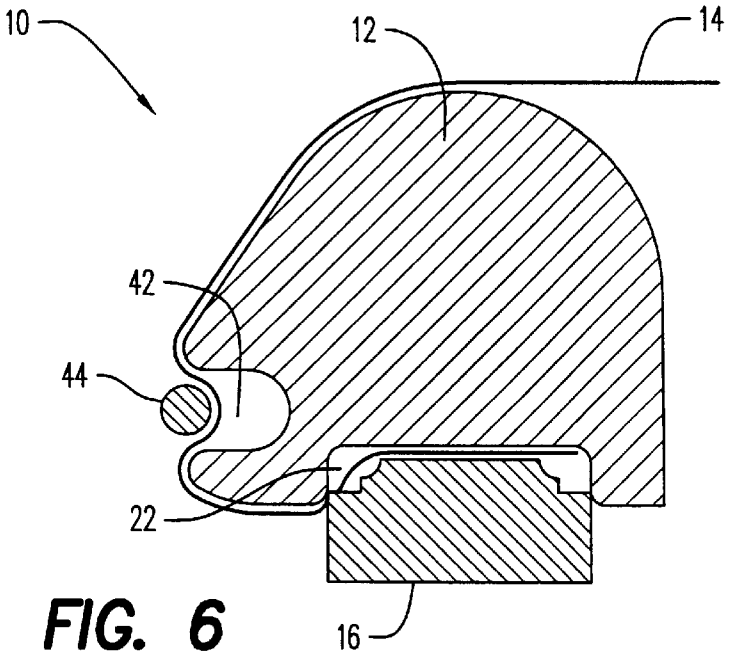
FIG. 6 is a partial cross-sectional view of a sixth embodiment of a drum head assembly according to the present invention.

The alternate preferred embodiment of the drum head assembly 10 depicted in FIG. 6 includes skin mounting ring 16 of the previous embodiments. The frame 12 has the rounded contour of bearing rings 18 of previous embodiments, and also includes channel 22 to accept skin mounting ring 16. In this embodiment, an outer indentation 42 is formed about frame 12. This indentation 42 is designed to accept a tension wire 44 mounted about frame 12 on the opposite side of skin 14. In this embodiment, tension wire 44 acts as the bearing ring 18 to apply or release tension to skin 14. The tension wire 44 is drawn into indentation 42 on frame 12, drawing skin 14 with it, when tension wire 44 is tightened by drawing clamp sections 49 and 50 (see FIG. 9, discussed below), which are attached to each end of tension wire 44, and held together by screw 48 (discussed further below). Other possible methods include using a hose clamp, a double bolt clamp, or a spiral double bolt clamp. All function for the same purpose of providing circumferential pressure inward to increase tension on the skin.

In the foregoing embodiments, the various elements of drum head assemblies 10 can be made of a variety of materials. Screws 22 are preferably made of hard, durable material such as plastic or metal. Frames 12, bearing rings 18 and skin mounting rings 16 can be made of plastic, wood, metal or other materials. Skins 14 can be made of any thin material such as plastic, Mylar, fabric, animal skin, or combinations of these (such as vinyl-coated fabrics). As discussed above, flange 36 of the FIG. 3 embodiment is preferably made of steel. The tension wire 44 of the FIG. 6 embodiment is preferably made of metal wire or cable.

Drum head assemblies 10 of the present invention are easily mounted to and removed from drum bodies. Moreover, skins 14 do not require elaborate or expensive retaining edges or glued-on rims to be mounted securely.

FIG. 7 shows frame 12 of drum head assembly 10 of FIG. 1. Slots 32 are shown as the inner set of holes. The number of inner slots 32 used is based on the rigidity of bearing ring 18, with eight such slots 32 being shown here as an example. An outer set of mounting holes 46 is also shown. The number of outer holes 46 is dependent on the rigidity of the skin mounting ring 16, with eight being shown here as an example. Mounting holes 46 can, but need not, pass entirely through frame 12. Mounting holes 46 are designed to accept mounting pins (not shown) to further unite frame 12 and skin mounting ring 16, and optionally to descend below frame 12 to engage mating holes on the drum body. The mounting method is dependent on material and shape constraints of the drum shell that is being used. This mounting can optionally be made permanent by the use of adhesive on the mounting pins when a simpler, less expensive drum is required.

Figure 8:
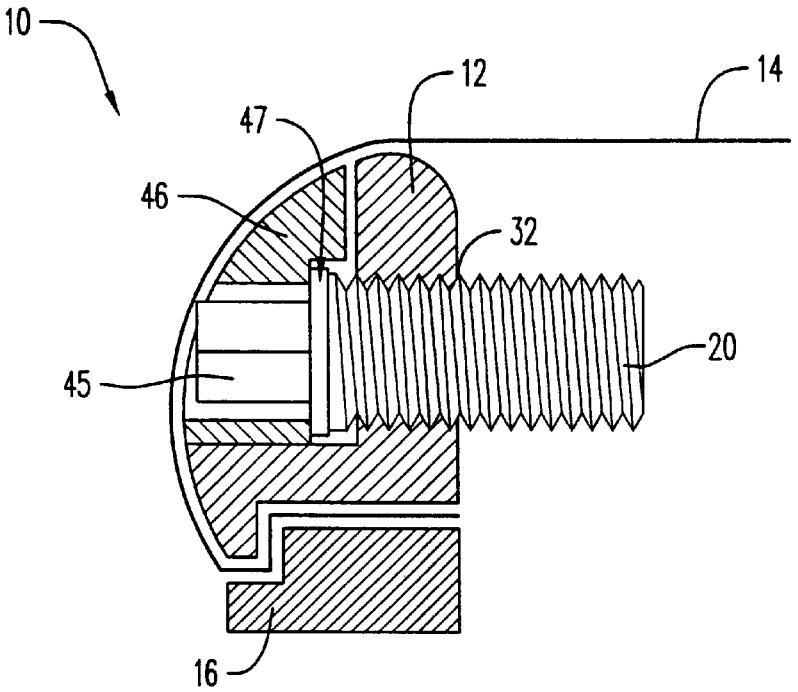
FIG. 8 is a partial cross-sectional view of an eighth embodiment of a drum head assembly according to the present invention.

FIG. 8 depicts a further preferred embodiment of the drum head assembly 10 of the present invention. In this embodiment, frame 12 had a configuration similar to that of the embodiment of FIG. 6. In the embodiment of FIG. 8, however, tension is produced by screws 20 which have a flange 47 that abuts the tension section 46 such that as grippable head 45, in this case fitting a conventional drum wrench, is turned out through a hole in the head, tension section 46 is forced out against the skin. Such a configuration will allow the drum head assembly 10 to be used on any shape shell, and will allow the tensioning to be done on the outside of assembly 10.

Figure 9:
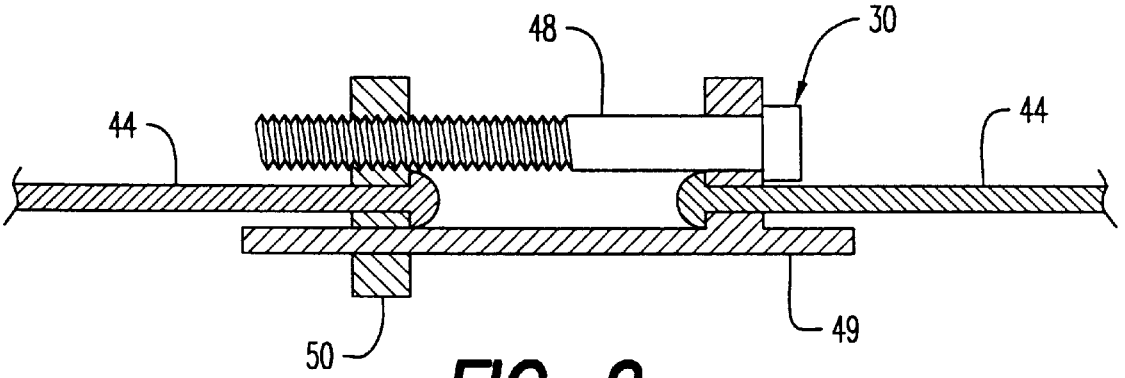
FIG. 9 is a partial cross-sectional view of a second mounting ring embodiment, absent the tensioning variations as shown in FIGS. 1 through 8.

FIG. 9 depicts a cable tensioning method to be used with drum head assembly 10 of FIG. 6. It includes a cable 44 with one terminus attached to stationary plate 49 and the other attached to sliding plate 50, which is fitted into stationary plate 49 to allow linear motion but not rotational motion. Tension is provided as grippable head 30 is rotated, turning screw 48 and drawing movable plate 50 closer to stationary plate 49. Once sufficient pressure is circumferentially applied to skin 14, the final adjustments to increase or decrease pressure are made by adjustment rotations of screw 48.

Figure 10:
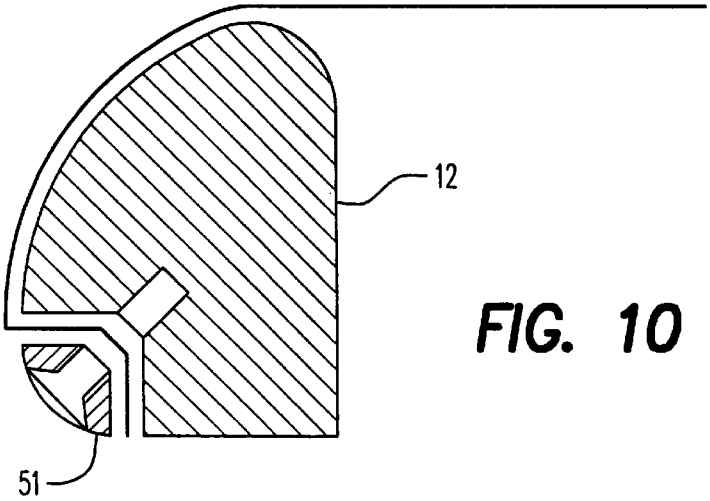
FIG. 10 is a partial cross-sectional view of a third mounting ring embodiment, absent the tensioning variations as shown in FIGS. 1 through 8.

FIG. 10 shows a further embodiment of another mounting ring 51 being mounted on the outside of frame 12. The tensioning method of frame 12 is not shown. The mounting ring 51 can be mounted to the exterior lower section of frame 12 by similar methods as described for skin mounting ring 16.

Figure 11:
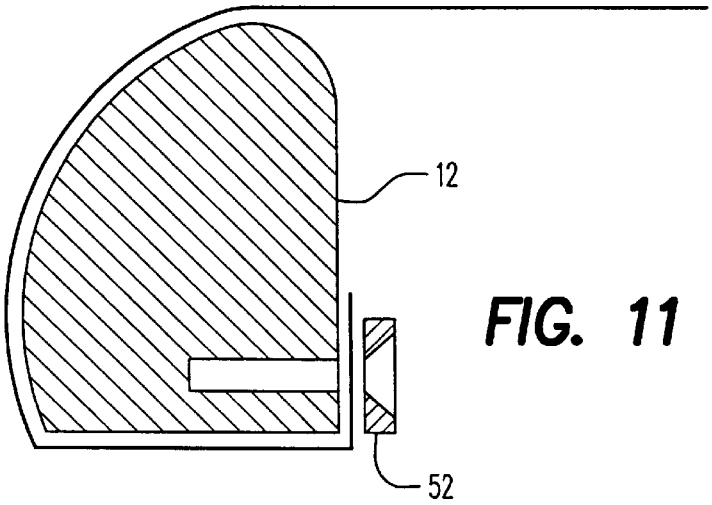
FIG. 11 is a partial cross-sectional view of a fourth mounting ring embodiment, absent the tensioning variations of FIGS. 1 through 8.

FIG. 11 shows a further embodiment of another mounting ring 52 being mounted on the inside of frame 12. The tensioning method of frame 12 is not shown. Here the mounting ring 52 can be mounted to the interior lower section of frame 12 by similar methods as described for skin mounting ring 16.

Figure 12:
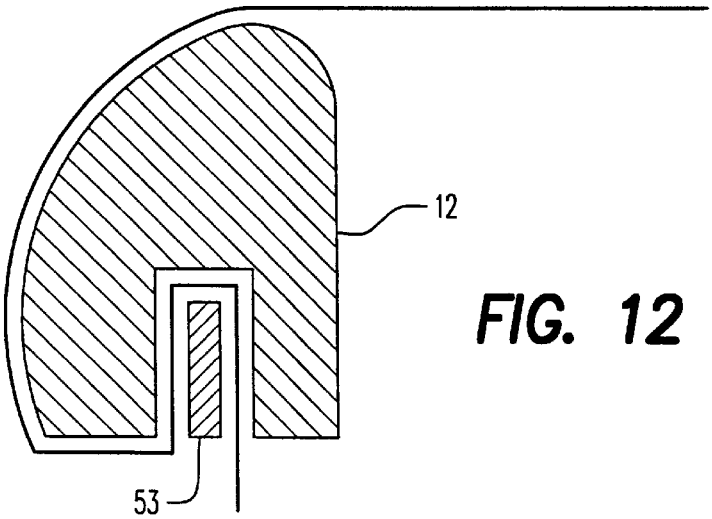
FIG. 12 is a partial cross sectional view of a fifth mounting ring embodiment, absent the tensioning variations of FIGS. 1 through 8.

FIG. 12 also shows a further embodiment of another mounting ring 52 being mounted to frame 12. The tensioning method of frame 12 again is not shown. In this embodiment, the mounting ring 53 is pressed into frame 12 and contained by the attachment of a shell (not shown).

Various modifications may be made as will be apparent to those skilled in the art. Thus, it will be obvious to one of ordinary skill in the art that the foregoing description and drawings are merely illustrative of certain preferred embodiments of the present invention, and that various obvious modifications can be made to these embodiments within the scope of the appended claims.

What is claimed is:

1. An integral drum head assembly comprising:

a drum head frame having an outer surface and a mounting surface, said mounting surface being located below or opposite said outer surface;

a skin positioned about said outer surface and said mounting surface of said frame;

means for mounting said skin firmly to said frame at said mounting surface; and means for tensioning said skin, said skin tensioning means having a surface for pressing against said skin, and having means for adjustably moving said tensioning means surface relative to said frame.

2. The drum head assembly of claim 1, wherein said frame has a channel located in said mounting surface.

3. The drum head assembly of claim 2, wherein said mounting means has a ring arranged to seat within said channel.

4. The drum head assembly of claim 1, wherein said skin tensioning means is located below or opposite said outer surface of said frame so as to avoid obstructing the playing of said drum head assembly.

5. The drum head assembly of claim 1, wherein said skin tensioning means has a bearing ring for contacting said skin and at least one screw, said at least one screw applying pressure to and moving said bearing ring against said skin.

6. The drum head assembly of claim 5, wherein said skin has at least one hole arranged to receive said at least one screw.

7. The drum head assembly of claim 5, wherein said frame includes at least one screw-receiving slot, and wherein said at least one screw is arranged to rotate within said at least one screw-receiving slot.

8. The drum head assembly of claim 7, wherein said screw-receiving slot also passes through said mounting means.

9. The drum head assembly of claim 5, wherein said bearing ring has a tapered upper surface.

10. The drum head assembly of claim 5, wherein said bearing ring is annular.

11. The drum head assembly of claim 4, wherein said bearing ring has a depending lip that contacts said frame.

12. The drum head assembly of claim 11, wherein said depending lip and said frame have mating notched surfaces for incremental movement of one of said depending lip and said frame with respect to the other.

13. The drum head assembly of claim 12, wherein said frame and said bearing ring are made of plastic.

14. The drum head assembly of claim 11, wherein said depending lip and said frame have mating threaded surfaces capable of relative rotational and vertical movement.

15. The drum head assembly of claim 14, wherein said frame and said bearing ring are made of plastic.

16. The drum head assembly of claim 5, further comprising a flange intermediate said at least one screw and said bearing ring.

17. The drum head assembly of claim 16, wherein said at least one screw is one of a plurality of eight screws, each of said plurality of screws applying pressure to and moving said bearing ring against said skin.

18. The drum head assembly of claim 1, wherein said frame has an indentation about a circumference thereof.

19. The drum head assembly of claim 18, wherein said skin tensioning means has a tension wire mounted about said frame and said skin at said indentation.

20. The drum head assembly of claim 1, further comprising means for attaching said drum head assembly to a drum body.

* * * * *